US006345603B1

(12) United States Patent
Abboud et al.

(10) Patent No.: US 6,345,603 B1
(45) Date of Patent: Feb. 12, 2002

(54) THROTTLE CONTROL FOR VEHICLE USING REDUNDANT THROTTLE SIGNALS

(75) Inventors: Amin Micheal Abboud, Livonia; Daniel Robert Parks, Novi, both of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/546,503

(22) Filed: Apr. 11, 2000

(51) Int. Cl.[7] ..... F02D 11/10
(52) U.S. Cl. ..... 123/397; 123/399
(58) Field of Search ..... 123/198 D, 361, 123/396, 397, 399, 479; 73/118.1

(56) References Cited

U.S. PATENT DOCUMENTS 4,022,170 A * 5/1977 Crall et al. ..... 123/488 X
4,922,425 A 5/1990 Mack et al. ..... 701/63
5,092,298 A 3/1992 Suzuki et al.
5,429,092 A 7/1995 Kamei
5,553,581 A 9/1996 Hirabayashi et al. ..... 123/399
5,602,732 A * 2/1997 Nichols et al. ..... 123/399 X
5,823,164 A 10/1998 Seki et al.
5,899,191 A 5/1999 Rabbit et al. ..... 123/479
5,950,597 A * 9/1999 Kamio et al. ..... 123/397
6,116,214 A * 9/2000 Ishida ..... 123/399
6,178,947 B1 * 1/2001 Machida et al. ..... 123/396
6,199,535 B1 * 3/2001 Hara ..... 123/396

* cited by examiner

*Primary Examiner*—Tony M. Argenbright
(74) *Attorney, Agent, or Firm*—Larry I. Shelton

(57) ABSTRACT

A throttle control system employs redundant throttle signals in which faults may be detected so that control may continue using a non-faulted channel when one channel fails. Rehabilitation of the failed channel may occur when the fault condition ends, and changes in throttle setting based on that rehabilitation, are phased in gradually to prevent abrupt changes in vehicle operation. In this way, high availability and reliability are obtained.

20 Claims, 2 Drawing Sheets

FIG. 1
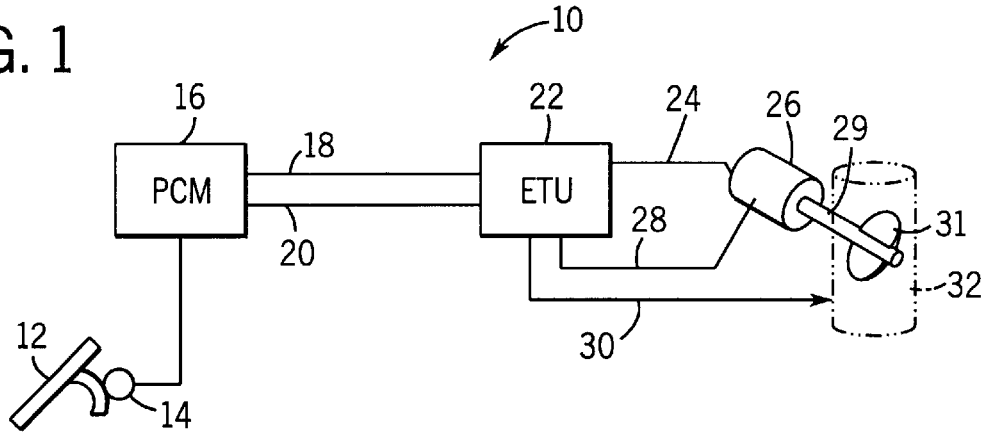
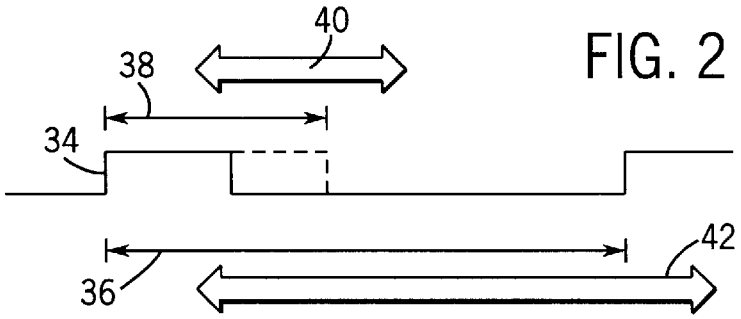
FIG. 2
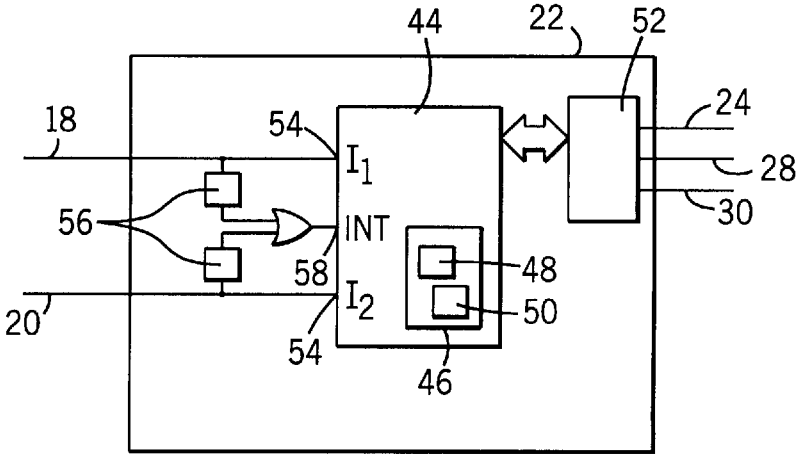
FIG. 3

THROTTLE CONTROL FOR VEHICLE USING REDUNDANT THROTTLE SIGNALS

CROSS-REFERENCE TO RELATED APPLICATIONS

STATEMENT REGARDING FEDERALLY SPONSORED RESEARCH OR DEVELOPMENT

BACKGROUND OF THE INVENTION

The present invention relates to electronically controlled throttles for vehicle engines and in particular to a high reliability throttle controller using redundant throttle signals.

A throttle controls the flow of air, or air and fuel, inducted into an internal combustion engine, and thereby controls the power produced by the engine. Engine power defines the speed of the engine or vehicle to which it is attached, under a given load condition, and thus, reliable control of the throttle setting is important.

In prior art mechanical systems, a direct mechanical linkage controlled the throttle, typically in the form of a cable running from the accelerator pedal, operable by the user of the automobile, to the throttle valve. Absent tension on the cable from the pedal, the throttle valve would revert to an idle opening under the influence of a biasing spring. The idle opening provides sufficient inducted air and gas to permit low speed operation of the engine under no- or low-load conditions.

Although mechanical linkages are simple and intuitive, they are not readily adapted to electronic control of an engine such as may be desired in sophisticated emissions reduction systems or for features such as automatic vehicle speed control. For these purposes, the mechanical linkage may be replaced with electrical wiring carrying throttle signals from a position sensor associated with the accelerator pedal to a throttle controller operating a motor actuating the throttle valve. The throttle signal may be monitored for loss or faults to provide greater reliability to the system.

It is desirable that any faults in the throttle signal be minimized to avoid disabling the vehicle unnecessarily. One method of reducing such faults is by using redundant throttle signals conveyed through separate control channels. If one channel fails, the non-faulted channel may be used to provide continued control to the engine. If both channels fail, the throttle is moved to a safe state.

Such systems may nevertheless be subject to conditions, such as intense electromagnetic interference, which can cause faults in both channels disabling them and causing a loss of availability of the throttle control.

BRIEF SUMMARY OF THE INVENTION

The present inventors have recognized that under certain circumstances, a faulted control channel may be rehabilitated once the fault is gone to provide substantially increased availability. Such rehabilitation creates a possibility of a sudden change in throttle plate position if the rehabilitated channel provides a throttle setting different from that currently in effect. This problem is addressed by a procedure which smoothly changes from one throttle setting to another in a "ramping" when a control channel is rehabilitated, thus preventing abrupt changes in engine power.

Specifically, the present invention provides a throttle control for a vehicle engine where the throttle control has an input for receiving a first and second redundant throttle signal providing throttle settings. A fault detection circuit communicates with the inputs to detect a fault, if any, in at least one of the first and second redundant throttle signals. A throttle signal processor receives information from the fault detector and the inputs and operates to (1) in the absence of a fault in at least one of the first and second throttle signals, to provide a normal throttle setting determined from the throttle settings of at least one of the first and second throttle signals, and (2) upon recovery from the fault of at least one of the first and second throttle signals, to produce a throttle command gradually transitioning between a fault throttle setting used during a fault of at least one of the first and second throttle signals and the normal throttle setting.

Thus it is a first object of the invention to permit the rehabilitation of faulted inputs in the throttle signals without creating an abrupt transition in vehicle power or speed. The gradual transition between the fault throttle setting and the normal throttle setting allows reaction and compensation by the operator of the vehicle.

Upon a fault of the first and second throttle signals, the fault throttle setting may produce an output signal adjusting the throttle to a setting within the idle range of the engine.

Thus it is another object of the invention to provide for operation of the vehicle but at a reduced capacity in the event of a complete failure of the throttle signals.

Alternatively, the fault throttle setting may be determined from a throttle setting of the non-faulted one of the first and second throttle signals when only one of the first and second throttle signals has failed.

Thus it is another object of the invention to provide for continued operation during a failure of one signal yet with the gradual recovery described above when the signal is rehabilitated.

Alternatively or in addition, the fault throttle setting may be used when the first and second throttle signals deviate in value by an amount greater than a predetermined deviation amount and the fault throttle setting may be determined from the first and second throttle signals associated with the lower throttle setting.

Thus it is another object of the invention to detect possible faults indicated by deviation in the values of the throttle signals and to adopt the more conservative throttle signal as the fault throttle setting.

The fault throttle setting may be produced only when the fault condition exceeds a predetermined time.

Thus it is another object of the invention to allow continued throttle operation for extremely short, intermittent fault situations.

The throttle setting when neither the first nor second throttle signal is faulted may be based on a preferred one and only one of the first and second throttle signals.

Thus it is another object of the invention to provide a simple method of converting redundant throttle signals into a single throttle setting.

The throttle signals may be a series of pulses whose widths represent throttle settings. The fault detection circuit may indicate a fault when either the frequency of the pulses or their width exceeds a predefined range.

Thus it is another object of the invention to provide a redundant fault detection system such that provides good assurance that when no fault is detected, that the signal may be rehabilitated for use in controlling the throttle.

The foregoing and other objects and advantages of the invention will appear from the following description. In the description, reference is made to the accompanying drawings, which form a part hereof, and in which there is shown by way of illustration a preferred embodiment of the invention. Such embodiment does not necessary represent the full scope of the invention, however, and reference must be made to the claims herein for interpreting the scope of the invention.

BRIEF DESCRIPTION OF THE DRAWINGS

FIG. 1 is a schematic state block diagram showing the communication of redundant throttle signals from a power train control module to an electronic throttle unit which provides a closed loop feedback control of an electronically controlled throttle actuator;

FIG. 2 is a graphical representation of a pulse width modulation of the redundant throttle signals to encode the throttle setting in the duty cycle of the pulses and showing a duty cycle window and frequency window used to detect faults of the throttle signals;

FIG. 3 is a schematic representation of the electronic throttle unit of FIG. 1 showing edge detection circuitry used for monitoring faults in the throttle signals and showing a microcontroller executing the fault detection program and a throttle signal processing program of the preferred embodiment of the present invention;

DETAILED DESCRIPTION OF THE INVENTION

Figure 4:
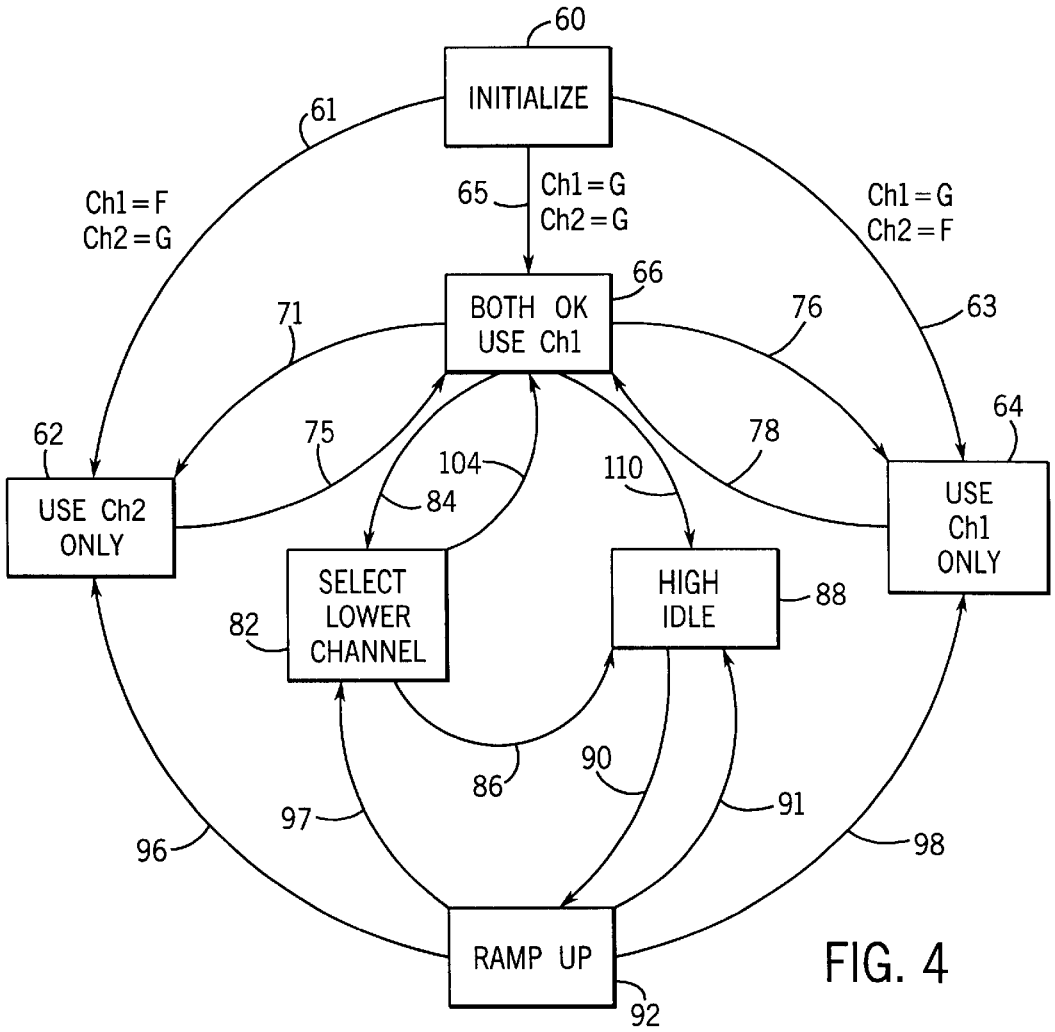
FIG. 4 is a state diagram of the throttle signal processing program of FIG. 3 showing its operation under various fault conditions.

Referring now to FIG. 1, a throttle control system 10 includes an accelerator pedal 12 attached to a pedal position sensor 14 such as may indicate the angular deflection of the accelerator pedal 12 as actuated by the vehicle driver.

The pedal position sensor 14 provides a signal to the power train control module 16 which encodes the signal from the pedal position sensor 14 into a redundant first throttle signal 18 on a first channel, and second signal 20 on a second channel for transmission to an electronic throttle unit (ETU) 22. The channels may be separate conductors, so as to reduce the chance of loss of both signals from a conductor break, or may be time or frequency multiplexed signals on a single conductor.

The ETU 22 provides an output signal, indicating a throttle setting 24, to a throttle actuator 26, for example, an electric motor providing a rotating shaft 29 attached to a throttle valve 31 within the throttle body 32. The actuator 26 and/or throttle 32 may include sensors generating position feedback signal 28 and a redundant position feedback signal 30 indicating throttle valve position that may be used by the ETU for closed loop control of the throttle according to the throttle setting 24.

Referring now to FIG. 2, the throttle signals 18 and 20 may be pulse-width modulated (PWM) to produce a series of pulses 34 having pulse widths 38 and occurring at a regular frequency or period 36. The desired throttle setting 24 may be encoded in the pulse widths 38 which may vary within a pulse termination window 40 after a rising edge of the pulse 34 to indicate a full range of operation of the throttle valve 31. The frequency of the pulses 34 may vary within a pulse repetition rate window 42 conveying no throttle information but used for fault detection as will be described.

Referring to FIG. 3, the ETU 22 may include a microcontroller 44 holding a memory 46 including a fault detection program 48 and a throttle signal processing program 50 both which will be described. The microcontroller 44 may communicate with input/output circuitry 52 providing the signal indicating the throttle setting 24 and receiving the feedback signals 28 and 30 as described above with respect to FIG. 1.

The microcontroller 44 may also receive the throttle signals 18 and 20 at onboard inputs 54. The throttle signals 18 and 20 may also be received by edge detectors 56 detecting rising or falling edges of the pulses 34 to provide an interrupt input 58 causing execution of the fault detection program 48 as an interrupt service routine upon each rising edge. Generally, as shown in FIG. 2, the fault detection program 48 determines if there is a falling edge of the pulse 34 within pulse termination window 40 and then a subsequent rising edge within pulse repetition rate window 42. If either of these conditions is not met, for a predetermined period of time or number of pulses 34, a fault condition is associated with the given throttle signal 18 or 20. The particular throttle signal 18 or 20 associated with the fault may be deduced through an actual reading of the inputs 54.

Figure 5:
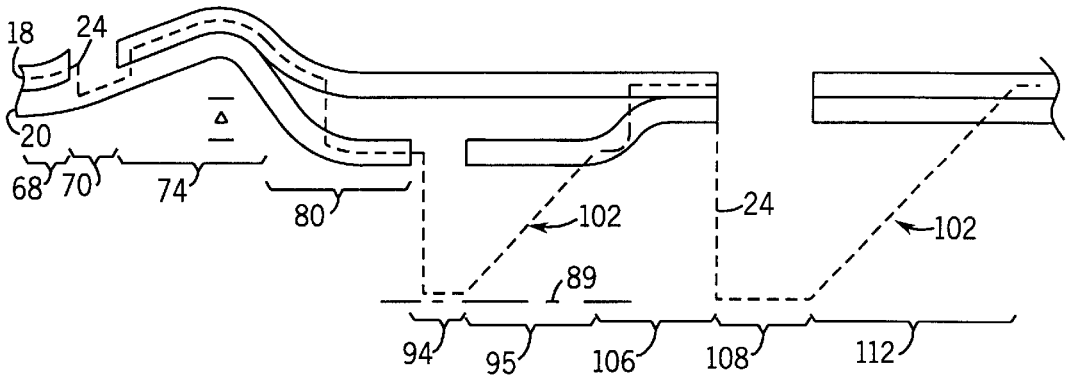
FIG. 5 is a graph of redundant throttle signals versus time showing various fault conditions and the throttle setting produced using the present invention.

Referring now to FIGS. 4 and 5, the throttle signal processing program responds to indications of faults on throttle signals 18 and 20 according to a state diagram executed by the throttle signal processing program 50. In this diagram, throttle signal 18 is designated as CHANNEL 1 and throttle signal 20 is designated as CHANNEL 2.

At an initialization of state block 60, the fault conditions of the throttle signals 18 and 20 are checked. If CHANNEL 1 is faulted but CHANNEL 2 is good, the program proceeds to state block 62 as indicated by state transition arrow 61 and CHANNEL 2 only is used to determine throttle setting. Generally this involves simply a conversion of the pulse width 38 into an angular position of the throttle according to a standard conversion for the particular actuator 26.

Conversely if CHANNEL 1 is good and CHANNEL 2 is faulted, the program proceeds to state block 64 as indicated by state transition arrow 63 and the CHANNEL 1 signal is used only.

More typically, CHANNEL 1 will be good and CHANNEL 2 will be good and the program will proceed to state block 66 as indicated by state transition arrow 65 where both channels are good and CHANNEL 1 is used for control of the throttle. Once at state block 66, should CHANNEL 1 fault, the program proceeds to state block 62 as indicated by state transition arrow 71. Conversely, once at state block 66, should CHANNEL 2 fault, the program proceeds to state block 64 as indicated by state transition arrow 76.

The present invention allows for rehabilitation of the CHANNELS and return from state blocks 62 (via state transition arrow 75) or state block 64 (via state transition arrow 78) if the fault conditions in the respective CHANNELS 1 or CHANNEL 2 should disappear. Rehabilitation is instantaneous with the disappearance of the fault, in contrast to the fault condition which requires a predetermined time interval of a fault condition.

Referring to FIG. 5, the program 50 may be at state block 66 during period 68 shown in FIG. 5 during which both CHANNELS vary but nevertheless track each other. Throttle setting 24 then tracks throttle signal 18 of CHANNEL 1.

During subsequent period 70, CHANNEL 1 may fail as indicated by the break in the line indicating signal 18, causing the throttle setting 24 to drop to follow the second throttle signal 20 per state block 62 and state transition arrow 71.

During next period 74, throttle signal 18 may be restored for example if the failure was intermittent, and the program will proceed back to state block 66 per state transition arrow 75 increasing the availability of the channels during throttle operation.

Referring to FIGS. 4 and 5 at interval 80, the CHANNEL 1 and 2 signals may begin to deviate from each other by more than a predetermined amount A and the program 50 may move from state block 66 to state block 82 per state transition arrow 84. In this state, the throttle setting 24 tracks the CHANNEL with the lower throttle signal thus ensuring a conservative operation of the vehicle.

If CHANNEL 2 or the lower channel should then fault during interval 94, then as indicated by state transition arrow 86, the throttle setting 24 will drop to a high idle level 89. High idle level is set so that the engine will remain running and will permit driving the vehicle at a very low speed of around 5 miles per hour to a service center. This high idle condition is shown by state block 88 and this transition is indicated by state transition arrow 86.

If at state block 88, one or both of the CHANNELS stops being faulted as shown in interval 95, then as indicated by state transition arrow 90, the program 50 proceeds to the ramp up state 92 in which the throttle setting 24 ramps upward either to (1) the lower of the two throttle signals of state block 82 as shown by state transition arrow 97, (2) to the CHANNEL 2 value per state block 62 if CHANNEL 2 recovers as indicated by state transition arrow 96 or (3) to the CHANNEL 1 value of state block 64 if CHANNEL 1 recovers as indicated by state transition arrow 98. If the fault returns during the ramping process, the state block 88 is returned to, but with the same smooth ramping between the last throttle setting (which may have been arrived at during an incomplete ramping) and the high idle state 89.

Importantly however, the transition is not immediate but follows a smooth ramp 102 taking from approximately 0.5 to 2 seconds to complete indicated by interval 95. This time is set to allow the operator of the vehicle to react to the change in throttle setting if it is undesired. For example, if during throttle failure, the user has pressed the accelerator pedal to the full downward position, this ramping allows the user to release the accelerator pedal as the speed ramps upward. The ramping prevents the user from being surprised by an abrupt transition in throttle setting upward or downward.

From state block 92, and during interval 106, the rehabilitation of CHANNEL 2 may thus cause program 50 to move to state block 82 per state transition arrow 96, with the throttle setting 24 returning to CHANNEL 2 control. If CHANNEL 1 is then rehabilitated, the program 50 may move to state block 66 via state transition arrow 104.

If as shown in interval 108, both CHANNELS fail together, the throttle setting 24 drops to the high idle level 89 following a transition from state block 66 to 88 along state transition arrow 110.

Again, when one or both CHANNELS are restored, the program 50 proceeds via state transition arrow 90 to the state block 92 and a ramp-up interval occurs during interval 112 when the fault value returns to the normal throttle setting in this case of CHANNEL 1 along either state transition arrow 98 and then along state transition arrow 78 to state block 66 or along state transition arrow 96 and then along state transition arrow 75 to state block 66.

The above description has been that of a preferred embodiment of the present invention, it will occur to those that practice the art that many modifications may be made without departing from the spirit and scope of the invention. In order to apprise the public of the various embodiments that may fall within the scope of the invention, the following claims are made.

We claim:

1. A throttle control for a vehicle engine comprising:

(1) an input for receiving a first and second redundant throttle signal providing throttle settings;

(2) a fault detection circuit communicating with the input to detect a fault, if any, in at least one of the first and second redundant throttle signals;

(3) a throttle signal processor communicating with the input and the fault detection circuit and operating to:

(i) in the absence of a fault in at least one of the first and second throttle signals to produce a normal throttle setting determined from the throttle settings of at least one of the first and second throttle signals;

(ii) upon recovery from a fault of at least one of the first and second throttle signals, to produce a throttle command gradually transitioning between a fault throttle setting used during a fault of at least one of the first and second throttle signals and the normal throttle setting;

(4) an output circuit receiving the throttle command to provide an output signal to an electrically controllable throttle;

whereby abrupt changes in throttle commands are avoided.

2. The throttle control of claim 1 wherein the throttle signal processor further operates to:

(iii) upon a fault of both of the first and second throttle signals to produce a fault throttle setting which provides an output signal adjusting the throttle to a setting within the idle range of the engine.

3. The throttle control of claim 1 wherein the input signals are a series of pulses whose width indicates throttle settings.

4. The throttle control of claim 3 wherein the fault detection circuit indicates a fault when the frequency of the pulses of the input signals passes outside a predefined frequency range.

5. The throttle control of claim 4 wherein the fault detection circuit indicates a fault when the frequency of the pulses of the input signals passes outside a predefined frequency range in excess of a predetermined fault time.

6. The throttle control of claim 3 wherein the fault detection circuit indicates a fault when the width of the pulses of the input signals passes outside a predefined width range.

7. The throttle control of claim 6 wherein the fault detection circuit indicates a fault when the width of the pulses of the input signals passes outside a predefined width range in excess of a predetermined fault time.

8. The throttle control of claim 1 wherein the throttle signal processor further operates to: (iii) upon a fault of one of the first and second throttle signals to produce a fault throttle setting determined from the throttle setting of a non-faulted one of the first and second throttle signals.

9. The throttle control of claim 1 wherein the throttle command determined from the throttle settings of both of the first and second throttle signals is functionally related to a preferred one and only one of the first and second throttle signals.

10. The throttle control of claim 1 wherein the throttle signal processor further operates to: (iii) upon a deviation between the first and second throttle signals of greater than a predetermined deviation amount, to produce a fault throttle setting determined from the throttle setting one of the first and second throttle signals associated with a throttle setting of less throttle opening.

11. The throttle control of claim 10 wherein the fault throttle setting is only produced upon a deviation between of the first and second throttle signals of greater than a predetermined deviation amount for a predetermined tracking time.

12. A method of controlling a throttle using first and second redundant throttle signal providing throttle settings comprising the steps of:

(1) detecting a fault, if any, in at least one of the first and second redundant throttle signals;

(2) in the absence of a fault in at least one of the first and second throttle signals to produce a normal throttle setting determined from the throttle settings of at least one of the first and second throttle signals;

(4) upon recovery from a fault of one of the first and second throttle signals, to produce a throttle command transitioning between a fault throttle setting used during a fault of at least one of the first and second throttle signals of the normal throttle setting; and (5) using the throttle command to provide an output signal to an electrically controllable throttle; whereby abrupt changes in throttle commands are avoided.

13. The method of claim 12 wherein the predetermined failure value provides and output signal within the idle range of the engine.

14. The method of claim 12 wherein the input signals are a series of pulses whose width indicates throttle setting and wherein a fault is detected when the frequency of the pulses of the input signals passes outside a predefined frequency range.

15. The method of claim 12 wherein the input signals are a series of pulses whose width indicates throttle setting and wherein a fault is detected when the frequency of the pulses of the input signals passes outside a predefined frequency range in excess of a predetermined fault time.

16. The method of claim 12 wherein the input signals are a series of pulses whose width indicates throttle setting and wherein a fault is detected when the width of the pulses of the input signals passes outside a predefined width range.

17. The method of claim 12 wherein the input signals are a series of pulses whose width indicates throttle setting and wherein a fault is detected when the width of the pulses of the input signals passes outside a predefined width range in excess of a predetermined fault time.

18. The method of claim 12 including the further steps of:

(6) upon a fault of one of the first and second throttle signals to produce a fault throttle setting determined from the throttle settings of a non-faulted one of the first and second throttle signals.

19. The method of claim 12 wherein the throttle command determined from the throttle settings of both of the first and second throttle signals is functionally related to a preferred one and only one of the first and second throttle signals.

20. The method of claim 12 including the further steps of:

(6) upon a deviation between the first and second throttle signals of greater than a predetermined deviation amount, to produce a fault throttle setting determined from the throttle settings of one of the first and second throttle signals associated with a throttle setting of less throttle opening.

* * * * *

UNITED STATES PATENT AND TRADEMARK OFFICE

CERTIFICATE OF CORRECTION

PATENT NO. : 6,345,603 B1
DATED : February 12, 2002
INVENTOR(S) : Abboud et al.

It is certified that error appears in the above-identified patent and that said Letters Patent is hereby corrected as shown below:

Title page,
Item [75], Inventor name "Amin Micheal Abboud" should be -- Amin Michael Abboud --.

Column 5,
Line 8, "A" should be -- Δ --.

Column 7,
Line 1, "setting one" should be -- setting of one --.
Line 28, "provides and output signal" should be -- provides an output signal --.

Signed and Sealed this

Twenty-second Day of October, 2002

*Attest:*

*Attesting Officer*

JAMES E. ROGAN
*Director of the United States Patent and Trademark Office*